US007815410B2

(12) United States Patent
Shinozuka

(10) Patent No.: US 7,815,410 B2
(45) Date of Patent: Oct. 19, 2010

(54) VEHICLE PARKING APPARATUS AND ELEVATOR APPARATUS

(75) Inventor: Hiroyuki Shinozuka, Tokyo (JP)

(73) Assignee: Ishikawajima Transport Machinery Co., Ltd., Tokyo (JP)

( * ) Notice: Subject to any disclaimer, the term of this patent is extended or adjusted under 35 U.S.C. 154(b) by 830 days.

(21) Appl. No.: 11/325,274

(22) Filed: Jan. 4, 2006

(65) Prior Publication Data

US 2006/0182546 A1 Aug. 17, 2006

(30) Foreign Application Priority Data

Jan. 4, 2005 (JP) ..... 2005-000048

(51) Int. Cl.
*B66B 7/08* (2006.01)
*B66B 7/10* (2006.01)

(52) U.S. Cl. ..... 414/234; 187/411; 187/412

(58) Field of Classification Search ..... 414/234, 414/235, 236, 241, 256; 187/411, 412
See application file for complete search history.

(56) References Cited

U.S. PATENT DOCUMENTS 1,632,083 A * 6/1927 Kieckhefer ..... 187/412
2,148,123 A * 2/1939 Hymans ..... 187/411
2,165,542 A * 7/1939 Gaither ..... 187/412
5,149,922 A * 9/1992 Kondou ..... 187/392
5,383,757 A * 1/1995 Takaoka et al. ..... 414/240
5,476,159 A * 12/1995 Cho ..... 187/289
5,564,530 A * 10/1996 Iwakiri et al. ..... 187/411
5,611,412 A * 3/1997 Yoo et al. ..... 187/412
5,750,945 A * 5/1998 Fuller et al. ..... 187/292

(Continued)

FOREIGN PATENT DOCUMENTS

JP 60-43676 3/1985

(Continued)

OTHER PUBLICATIONS

Japanese Office Action for Application No. 2005-000048, mailed on Jan. 19, 2010 (3 pages).

(Continued)

*Primary Examiner*—James Keenan
(74) *Attorney, Agent, or Firm*—Osha Liang LLP

(57) ABSTRACT

A vehicle parking apparatus for parking a vehicle comprises a main structure having a plurality of storage racks capable of storing vehicles lined up in a vertical direction, a lift cage capable of being mounted with a vehicle, a coupling mechanism having a second coupling member, a first coupling member capable of making contact with the second coupling member from a lower side and capable of relative movement in a downward direction from a position of making contact with the second coupling member, and an urging mechanism causing a prescribed urging force to act in a downward direction on the first coupling member; a wire capable of suspending the lift cage in an elevator shaft H next to the storage racks via the coupling mechanism, and winding apparatus capable of winding the wire up and down. The first coupling member is fixed to one end of the wire, and the second coupling member is fixed to the lift cage. This makes it possible to provide a vehicle parking apparatus and elevator apparatus capable of being stably driven with a simple configuration.

14 Claims, 10 Drawing Sheets

U.S. PATENT DOCUMENTS

| | | | | |
|---|---|---|---|---|
| 5,862,888 | A * | 1/1999 | Iwakiri et al. | 187/345 |
| 5,893,696 | A * | 4/1999 | Belinsky | 414/255 |
| 6,223,862 | B1 * | 5/2001 | Barnes | 187/412 |
| 6,315,084 | B1 * | 11/2001 | Shon | 187/411 |
| 6,595,331 | B2 * | 7/2003 | Moncini | 187/408 |
| 2006/0175152 | A1 * | 8/2006 | Fargo et al. | 187/412 |

FOREIGN PATENT DOCUMENTS

| | | |
|---|---|---|
| JP | 4-336172 | 11/1992 |
| JP | 05-069253 | 9/1993 |
| JP | 6-129132 | 5/1994 |
| JP | 7-166732 | 6/1995 |
| JP | 7-40930 | 7/1995 |
| JP | 09-021246 A | 1/1997 |
| JP | 2000-297554 | 10/2000 |
| JP | 2001-173257 A | 6/2001 |

OTHER PUBLICATIONS

Japanese Office Action for related patent application No. 2005-000048, mailed Jun. 3, 2010, and partial translation thereof, 3 pages.
Patent Abstracts of Japan for application with Publication No. 04-336172, Publication Date: Nov. 24, 1992, 1 page.
Full mechanical English translation of Japanese patent application with publication No. 2000-297554, Publication Date: Oct. 24, 2000, 5 pages.

* cited by examiner

VEHICLE PARKING APPARATUS AND ELEVATOR APPARATUS

BACKGROUND OF INVENTION

1. Field of the Invention

The present invention relates to a vehicle parking apparatus where a vehicle is parked and an elevator apparatus for making the vehicle go up and down within an elevator shaft, and particularly relates to a vehicle parking apparatus and an elevator apparatus of a structure where a vehicle is suspended.

2. Background Art

Mechanical vehicle parking apparatus are utilized in parking of vehicles.

For example, a vehicle may be stored in vertically stacked storage racks.

An example of this type of vehicle parking apparatus is comprised of a number of palettes, a number of storage racks, an elevator apparatus, and a cage support apparatus.

The elevator apparatus is comprised of a lift cage, wire, and winding apparatus.

A palette is a quadrilateral structure in which a vehicle is mounted. The palette is convenient for handling various shapes and sizes of vehicles. With a typical vehicle parking apparatus, vehicles are handled using palettes. Some parking apparatus handle vehicles without using a palette.

Storage racks are racks capable of storing vehicles. A number of storage racks are lined up in a vertical direction. Ordinarily, a number of parking racks lined up vertically are arranged to the left and right of an elevator shaft. A vehicle loading and unloading area is provided midway along the elevator shaft.

A lift cage is a structure capable of being mounted with a vehicle. The lift cage is built-into a transfer apparatus for transferring a palette on which a vehicle is mounted between storage racks and the lift cage.

A wire is a mechanical element for suspending the lift cage along the storage racks.

A winding apparatus is capable of winding the wire up and down.

A cage support apparatus is an apparatus for supporting the lift cage within the building of the vehicle parking apparatus when the lift cage is lined up horizontally with one storage rack of a number of storage racks.

A description is now given of the operation when a vehicle is loaded into the vehicle parking apparatus.

A vehicle enters the lift cage placed at the vehicle loading and unloading area under its own propulsion.

The winding apparatus then winds up the wire. The lift cage is then stopped horizontally at one storage rack of the number of storage racks. The cage support apparatus supports the lift cage using the main structure of the building.

The transfer apparatus then transfers the palette the vehicle is on to a storage rack, and loading is complete.

Next, a description is given of the operation when a vehicle is unloaded from the vehicle parking apparatus.

The winding apparatus winds up the wire. The lift cage is then stopped horizontally at one storage rack of the number of storage racks. The cage support apparatus supports the lift cage using the main structure of the building.

The transfer apparatus then transfers the palette loaded with the vehicle from the storage rack to the lift cage.

The cage support apparatus then releases support of the lift cage.

The winding apparatus then winds down the wire, and the lift cage is lowered to the vehicle loading and unloading area.

The vehicle then exits from the vehicle loading and unloading area under its own propulsion.

The cage support apparatus makes the level of a rail surface of rails the palette is in at the lift cage and the level of the rail surface of the rails the palette is in the storage rack coincide, and then supports the lift cage using the main structure.

In a vehicle parking apparatus, there is a substantial difference in weight between an empty lift cage and an occupied lift cage.

For example, if the weight of an empty lift cage is 2.7 tons and the weight of a vehicle is 2.5 tons, it means that the difference in weight between when a lift cage is empty and loaded would be 2.5 tons.

When the cage support apparatus goes from a state of supporting a lift cage to a state of releasing support of the lift cage, the wire extends or contracts, and a load noise may occur because of a difference between the extent of extension of the wire from which the lift cage is hanging when loaded and the extent of extension of the wire from which the lift cage is hanging when empty.

If the cage support apparatus completely supports the gross weight of the lift cage, tension relating to the wire is unbalanced. Namely, a counterweight is suspended on the opposite side to where the lift cage of the wire is hanging. This means that force of the counterweight is acting on one side, while tension is no longer being generated on the opposite side.

The case where wire is wound onto a drive sheave and is wound up and wound down by a winding apparatus using friction is particularly inconvenient. For example, there may be cases where the friction between the drive sheave and the wires is insufficient, so that winding up of the wire or winding down of the wire becomes unstable.

This type of winding up apparatus has been adopted in recent years so that the winding apparatus does not become large in cases where the number of storage racks increase due to the number of cars parked increasing and it is therefore preferable to prevent the occurrence of this phenomenon.

In order to resolve the problems described above, the present invention provides vehicle parking apparatus and elevator apparatus capable of stable operation with a simple configuration.

SUMMARY OF INVENTION

In accordance with embodiments of the present invention, a vehicle parking apparatus for parking a vehicle comprises a main structure having a plurality of storage racks capable of storing vehicles lined up in a vertical direction, a lift cage capable of being mounted with a vehicle, a coupling mechanism having a second coupling member, a first coupling member capable of making contact with the second coupling member from a lower side and capable of relative movement in a downward direction from a position of making contact with the second coupling member, and an urging mechanism causing a prescribed urging force to act in a downward direction on the first coupling member; a wire capable of suspending the lift cage in an elevator shaft next to the storage racks via the coupling mechanism, and winding apparatus capable of winding the wire up and down. The first coupling member is fixed to one end of the wire, and the second coupling member is fixed to the lift cage.

With the configuration of the present invention, the plurality of storage racks of the main structure are capable of storing vehicles lined up vertically. The lift cage is capable of being mounted with a vehicle. The first coupling member is capable of making contact with the second coupling member from a lower side and capable of relative movement in a downward direction from a position of making contact with the second coupling member. The urging mechanism causes a prescribed urging force to act in a downward direction on the first coupling member. The wire is capable of suspending the lift cage in an elevator shaft next to the storage racks via the coupling mechanism. The winding apparatus is capable of winding the wire up and down. The first coupling member is fixed to one end of the wire, and the second coupling member is fixed to the lift cage.

As a result, it is possible for the lift cage loaded with a vehicle to be suspended from the wire and then be moved along the storage racks by winding the wire up and down using the winding apparatus. When the second coupling member comes into contact with the first coupling member, the lift cage is supported by the suspension force of the wire via the first coupling member and the second coupling member. When the second coupling member is not in contact with the first coupling member, the urging force applies tension to the wire via the first coupling member. The wire is therefore prevented from slackening.

The following is a description of several embodiments of vehicle parking apparatus of the present invention. The present invention may include any one of or a combination of two or more of the embodiments disclosed below.

In the vehicle parking apparatus of an embodiment of the present invention the prescribed urging force is smaller than the downward force acting on the second coupling member due to the weight of the lift cage while the lift cage that is not loaded with a vehicle is supported only by the suspension force of the wire.

With the above embodiment, the prescribed urging force is smaller than the downward force acting on the second coupling member due to the weight of the lift cage while the lift cage that is not loaded with a vehicle is supported only by the suspension force of the wire. As a result, while the lift cage is supported only by the suspension force of the wire, the first coupling member comes into contact with the second coupling member from the lower side so that the lift cage is supported by the suspension force of the wire via the first coupling member and the second coupling member.

Further, in the vehicle parking apparatus of an embodiment of the present invention, the urging mechanism has a resilient spring causing elastic force generated as a result of a change from a free length to a predetermined length to act on the first coupling member in a downward direction, and causing elastic force to act on a second coupling member in an upward direction.

In the configuration of the above embodiment, the resilient spring causing elastic force generated as a result of a change from a free length to a predetermined length to act on the first coupling member in a downward direction, and causing elastic force to act on a second coupling member in an upward direction. As a result, it is possible to cause a large urging force to act on the wire via the first coupling member using a light spring.

Further, in the vehicle parking apparatus of an embodiment of the present invention, the urging mechanism has a resilient spring causing elastic force generated as a result of a change from a free length to a predetermined length to act on the first coupling member in a downward direction, and causing elastic force to act on a second coupling member in an upward direction, and an adjustment mechanism capable of adjusting the predetermined length of the resilient spring.

In the configuration of the above embodiment, the resilient spring causing elastic force generated as a result of a change from a free length to a predetermined length to act on the first coupling member in a downward direction, and causing elastic force to act on a second coupling member in an upward direction. The adjustment mechanism is capable of adjusting the predetermined length of the resilient spring. As a result, it is possible to cause an urging force of a desired magnitude to act on the wire via the first coupling member using a light spring.

With the vehicle parking apparatus of embodiments of the present invention, the urging mechanism has a weight suspended from the first coupling member.

In the configuration of the aforementioned embodiment, a weight is suspended at the first coupling member. As a result, the weight of the weight is caused to act on the wire via the first coupling member.

The vehicle parking apparatus of the embodiments of the present invention is further comprised of detection means for detecting when the first coupling member moves in a relative manner downwards from a position of making contact with the second coupling member. When the detection means detects relative movement of the first coupling member, the winding apparatus stops winding down of the wire.

With the configuration of the aforementioned embodiment, when the detection means detects that the first coupling member has moved relatively downwards from a position of contact with the second coupling member, the winding apparatus stops winding down of the wire. As a result, the wire is prevented from being wound down more than necessary.

Moreover, the vehicle parking apparatus of the embodiments of the present invention further comprises cage support apparatus causing the lift cage to be supported by the main structure while the lift cage is horizontally lined up with one storage rack of the plurality of storage racks.

As a result of this configuration, the cage support apparatus causes the lift cage to be supported by the main structure while the lift cage is lined up laterally with one of the storage racks of the plurality of storage racks. As a result, the lift cage does not move up and down while the vehicle is moved between the lift cage and a storage rack. Moreover, the urging force acts on the wire during this time, and there is therefore no fluctuation in the suspension force of the wire while the cage support apparatus releases support of the lift cage.

Further, the vehicle parking apparatus of this embodiment of the present invention is such that the winding apparatus has a drive sheave for winding the wire up and down using frictional force generated as a result of winding of the wire, and a counterweight coupled to the other end of the wire.

As a result of this configuration, a drive sheave winds the wire up and down using frictional force generated as a result of winding of the wire. The counterweight is coupled to the other end of the wire. As a result, a force in excess of the urging force acts between one end of the wire and the drive sheave and the weight of the counterweight acts between the drive sheave and the other end of the wire so that operation of the winding apparatus is stable.

In the present invention, an elevator apparatus for lifting a vehicle up and down in an elevator shaft comprises a lift cage capable of being mounted with a vehicle, a coupling mechanism having a second coupling member, a first coupling member capable of making contact with the second coupling member from a lower side and capable of relative movement in a downward direction from a position of making contact with the second coupling member, and an urging mechanism causing a prescribed urging force to act in a downward direction on the first coupling member, a wire capable of suspending the lift cage in an elevator shaft via the coupling mechanism and winding apparatus capable of winding the wire up and down. The first coupling member is fixed to one end of the wire, and the second coupling member is fixed to the lift cage.

With the configuration of the present invention, the lift cage is capable of being mounted by a vehicle. The first coupling member is capable of making contact with the second coupling member from a lower side and capable of relative movement in a downward direction from a position of making contact with the second coupling member. The urging mechanism causes a prescribed urging force to act in a downward direction on the first coupling member. The wire is capable of suspending the lift cage in an elevator shaft via the coupling mechanism. The winding apparatus is capable of winding the wire up and down. The first coupling member is fixed to one end of the wire, and the second coupling member is fixed to the lift cage.

As a result, it is possible for the lift cage loaded with a vehicle to be suspended from the wire and then be moved within the elevator shaft by winding the wire up and down using the winding apparatus. When the second coupling member comes into contact with the first coupling member, the lift cage is supported by the suspension force of the wire via the first coupling member and the second coupling member. When the second coupling member is not in contact with the first coupling member, the urging force applies tension to the wire via the first coupling member. The wire is therefore prevented from slackening.

The following is a description of several embodiments of elevator apparatus of the present invention. The present invention may include any one of or a combination of two or more of the embodiments disclosed below.

In the elevator apparatus of an embodiment of the present invention, the prescribed urging force is smaller than the downward force acting on the second coupling member due to the weight of the lift cage while the lift cage that is not loaded with a vehicle is supported only by the suspension force of the wire.

With the above embodiment, the prescribed urging force is smaller than the downward force acting on the second coupling member due to the weight of the lift cage while the lift cage that is not loaded with a vehicle is supported only by the suspension force of the wire. As a result, while the lift cage is supported only by the suspension force of the wire, the first coupling member comes into contact with the second coupling member from the lower side, and the lift cage is supported by the suspension force of the wire via the first coupling member and the second coupling member.

Further, in the elevator apparatus of an embodiment of the present invention, the urging mechanism has a resilient spring causing elastic force generated as a result of a change from a free length to a predetermined length to act on the first coupling member in a downward direction, and causing elastic force to act on a second coupling member in an upward direction.

In the configuration of the above embodiment, the resilient spring causing elastic force generated as a result of a change from a free length to a predetermined length to act on the first coupling member in a downward direction, and causing elastic force to act on a second coupling member in an upward direction. It is therefore possible to cause a large urging force to act on the wire via the first coupling member using a light spring.

Further, in the elevator apparatus of an embodiment of the present invention, the urging mechanism has a resilient spring causing elastic force generated as a result of a change from a free length to a predetermined length to act on the first coupling member in a downward direction, and causing elastic force to act on a second coupling member in an upward direction, and an adjustment mechanism capable of adjusting the predetermined length of the resilient spring.

In the configuration of the above embodiment, the resilient spring causing elastic force generated as a result of a change from a free length to a predetermined length to act on the first coupling member in a downward direction, and causing elastic force to act on a second coupling member in an upward direction. The adjustment mechanism is capable of adjusting the predetermined length of the resilient spring. As a result, it is possible to cause an urging force of a desired magnitude to act on the wire via the first coupling member using a light spring.

With the elevator apparatus of the embodiments of the present invention, the urging mechanism has a weight suspended from the first coupling member.

In the configuration of the aforementioned embodiment, a weight is suspended at the first coupling member. As a result, the weight of the weight is caused to act on the wire via the first coupling member.

The elevator apparatus of the embodiments of the present invention is further comprised of detection means for detecting when the first coupling member moves in a relative manner downwards from a position of making contact with the second coupling member. When the detection means detects relative movement of the first coupling member, the winding apparatus stops winding down of the wire.

With the configuration of the aforementioned embodiment, when the detection means detects that the first coupling member has moved relatively downwards from a position of contact with the second coupling member, the winding apparatus stops winding down of the wire. As a result, the wire is prevented from being wound down more than necessary.

The elevator apparatus of the embodiment of the present invention is equipped with a cage support apparatus for causing the lift cage to be supported by the main structure arranged along the elevator shaft while the lift cage is stopped in the elevator shaft.

With the configuration of the above embodiment, the cage support apparatus causes the lift cage to be supported by the main structure while the lift cage is stopped in the elevator shaft. As a result, the lift cage does not move up and down. Further, during this time, an urging force acts on the wire, and the change in suspension force the wire subjects the lift cage to is small while the cage support apparatus releases support of the lift cage.

Further, the elevator apparatus of this embodiment of the present invention is such that the winding apparatus has a drive sheave for winding the wire up and down using frictional force generated as a result of winding of the wire, and a counterweight coupled to the other end of the wire.

As a result of this configuration, a drive sheave winds the wire up and down using frictional force generated as a result of winding of the wire. The counterweight is coupled to the other end of the wire. As a result, a force in excess of the urging force acts between one end of the wire and the drive sheave and the weight of the counterweight acts between the drive sheave and the other end of the wire and the operation of the winding apparatus is therefore stable. Other aspects and advantages of the invention will be apparent from the following description, figures, and the appended claims.

DETAILED DESCRIPTION

The following is a description with reference to the drawings of preferred embodiments of the present invention. In each drawing, portions that are common are given the same numerals and duplicated descriptions are avoided.

In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

First, a description is given of a parking apparatus of a first embodiment of the present invention based on the drawings.

Figure 1:
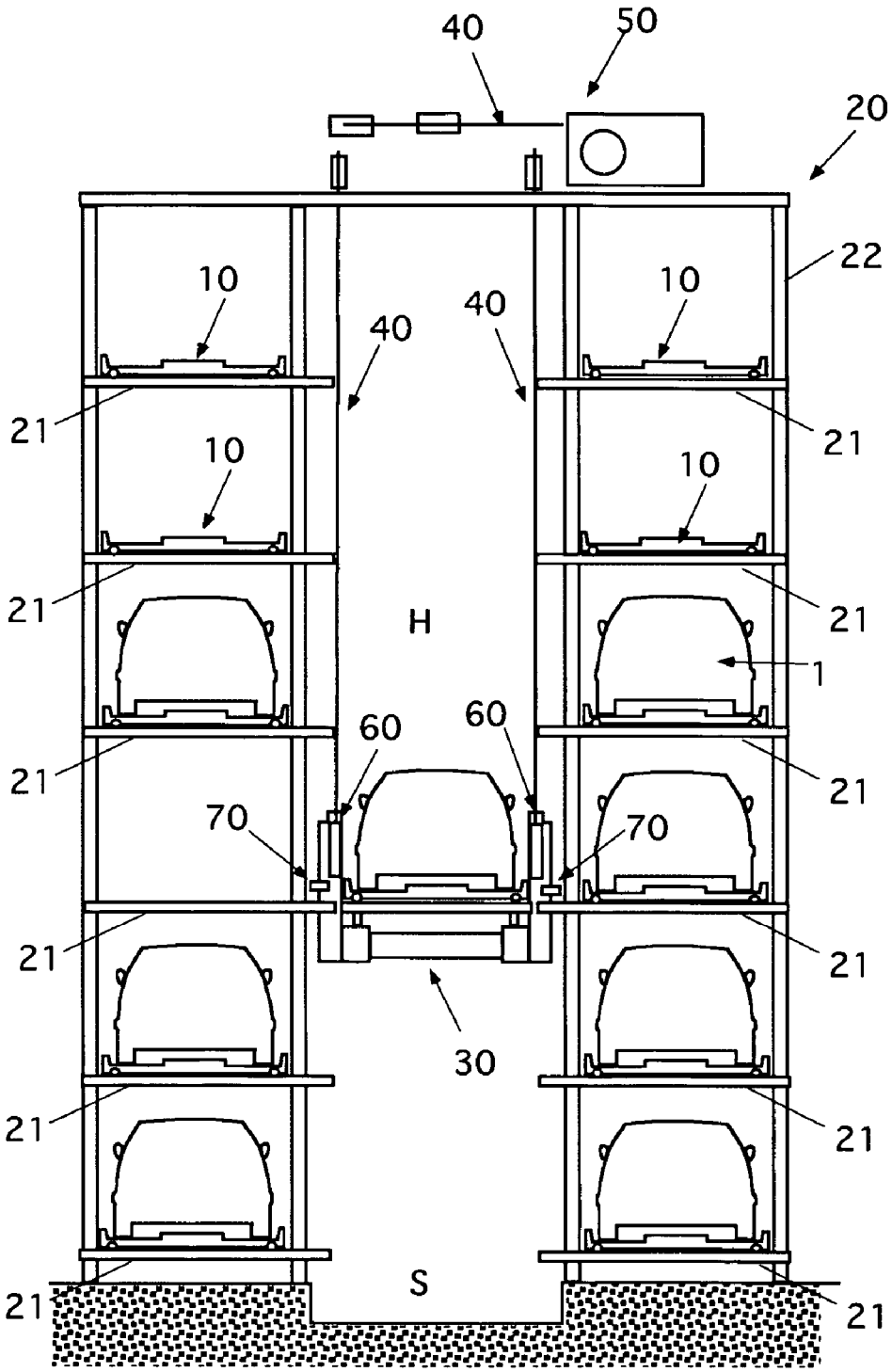
FIG. 1 is a front view of a parking apparatus of a first embodiment of the present invention.
Figure 2:
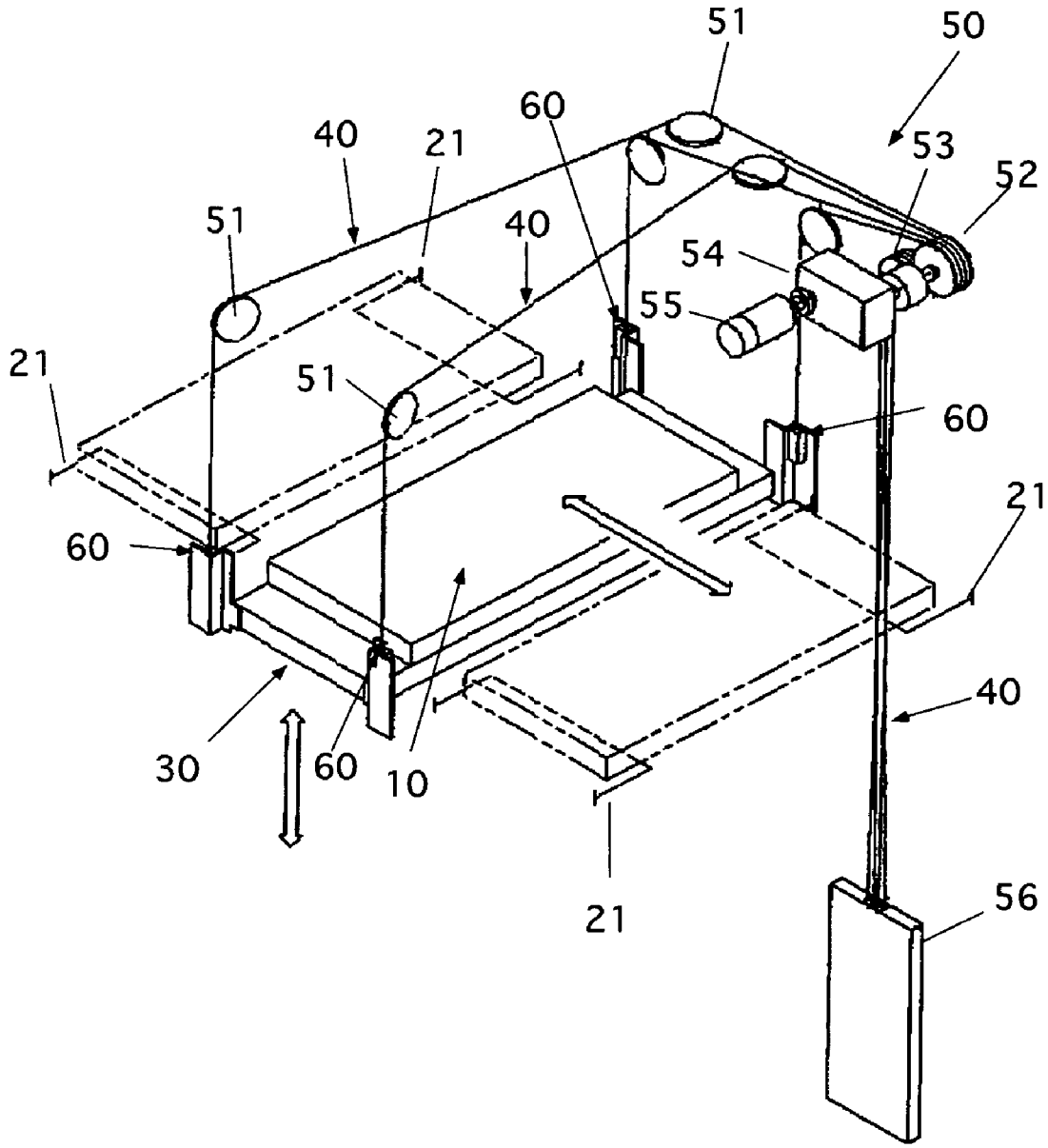
FIG. 2 is a perspective view of a parking apparatus of a first embodiment of the present invention.
Figure 3:
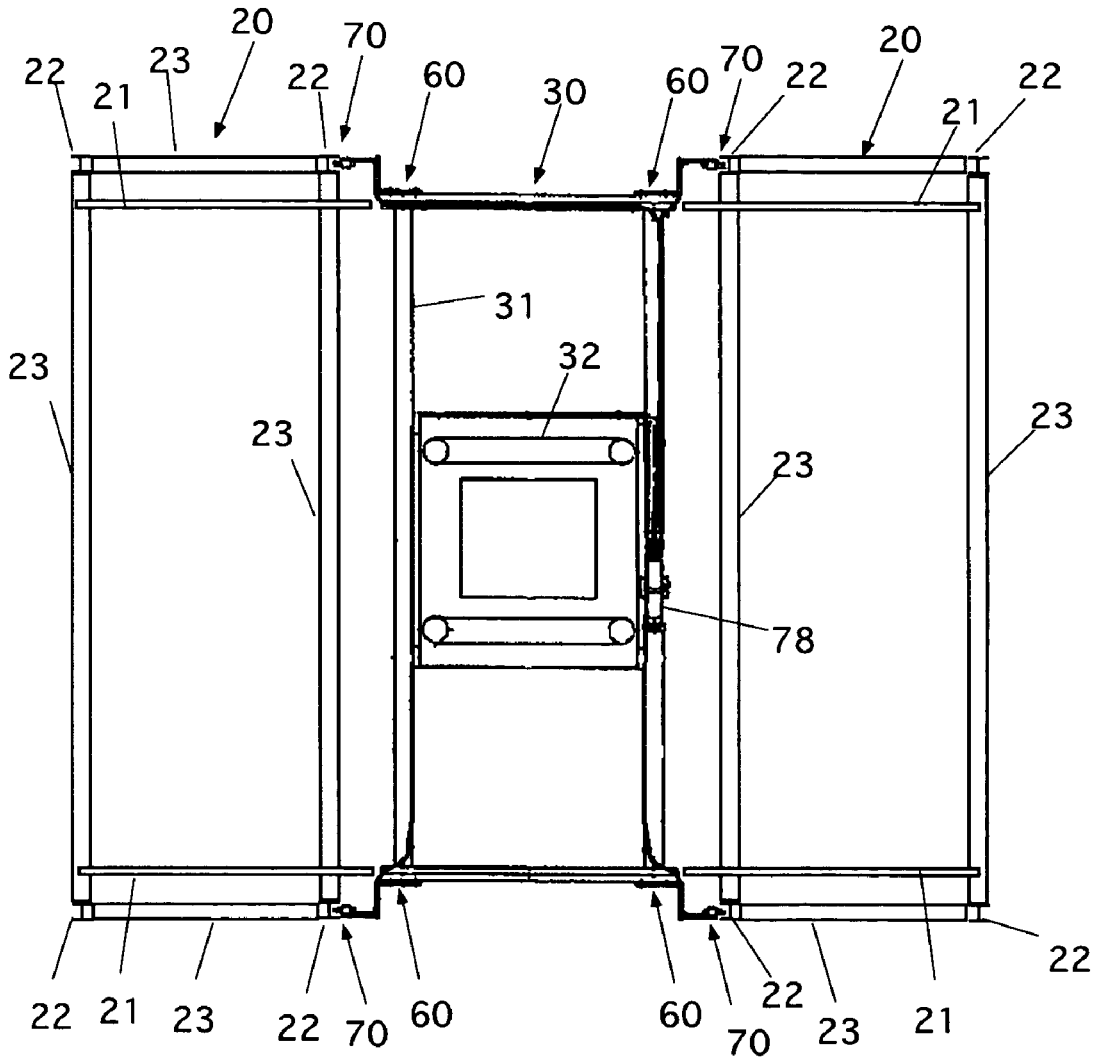
FIG. 3 is a plan view of a parking apparatus of a first embodiment of the present invention.
Figure 4:
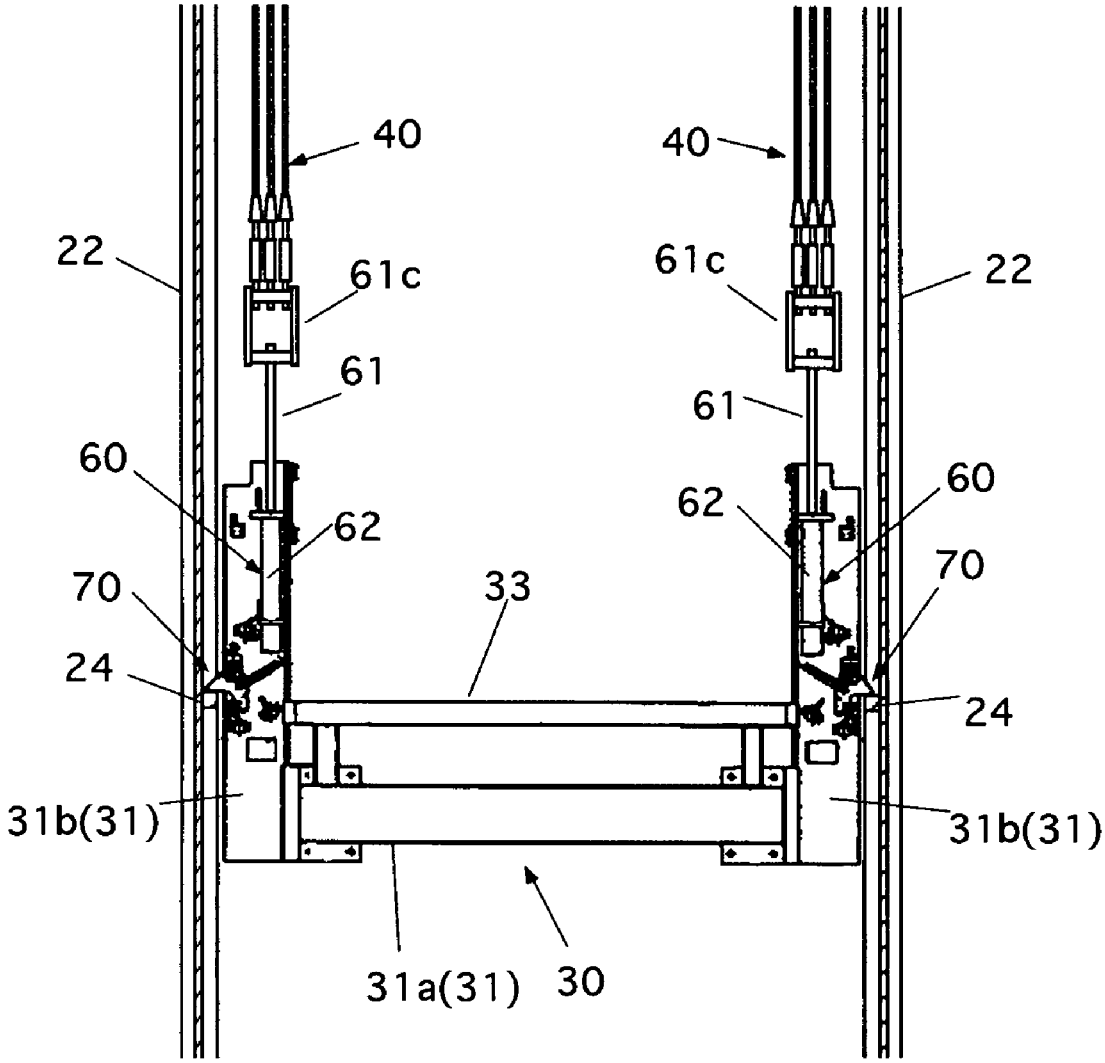
FIG. 4 is a cross-sectional view of a parking apparatus of a first embodiment of the present invention.
Figure 5:
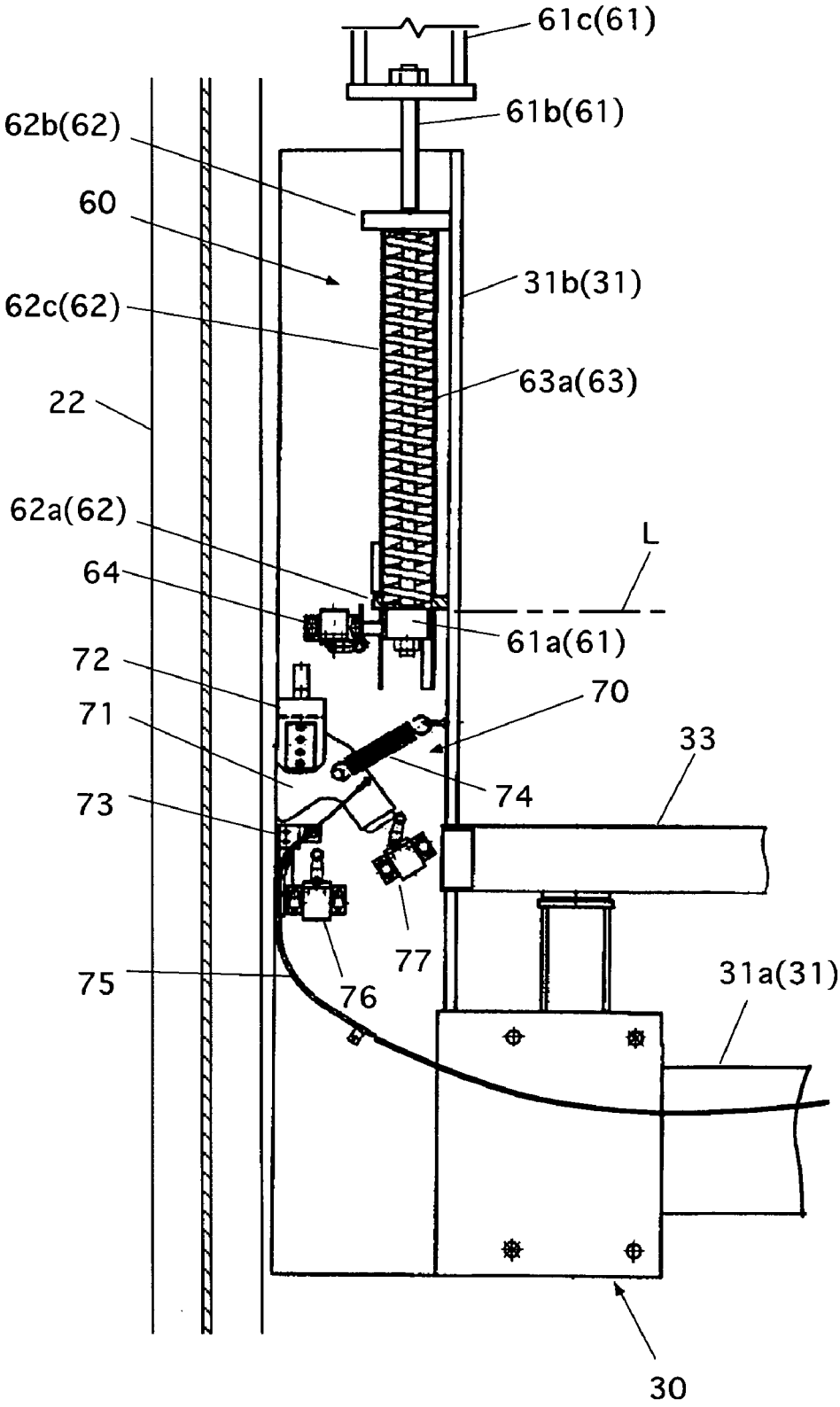
FIG. 5 is a partial view of a parking apparatus of a first embodiment of the present invention (one of two).
Figure 6:
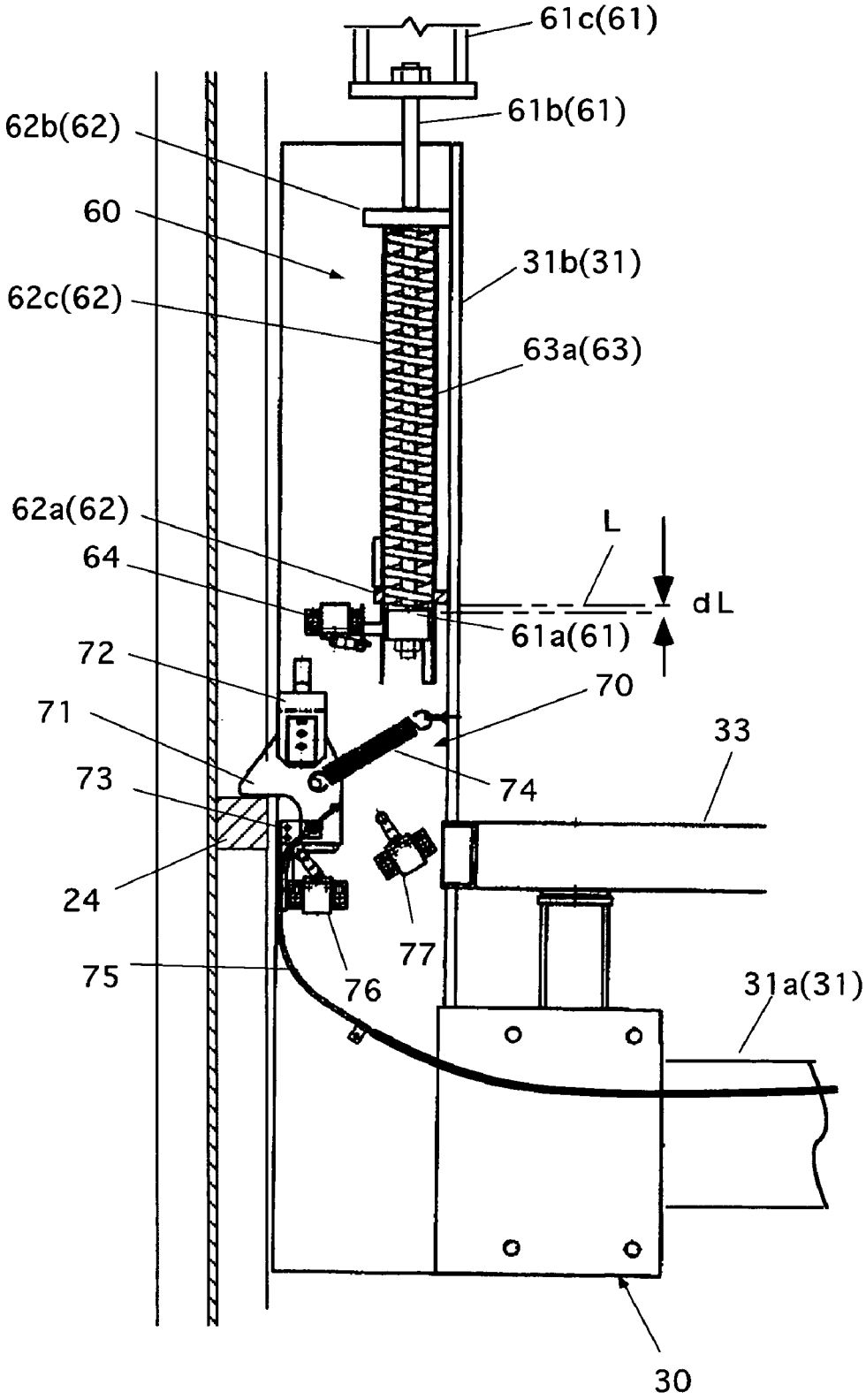
FIG. 6 is a partial view of a parking apparatus of a first embodiment of the present invention (two of two).

FIG. 1 is a front view of a parking apparatus of a first embodiment of the present invention. FIG. 2 is a perspective view of a parking apparatus of a first embodiment of the present invention. FIG. 3 is a plan view of a parking apparatus of a first embodiment of the present invention. FIG. 4 is a cross-sectional view of a parking apparatus of a first embodiment of the present invention. FIG. 5 is a partial view of a parking apparatus of a first embodiment of the present invention (one of two). FIG. 6 is a partial view of a parking apparatus of a first embodiment of the present invention (two of two).

The parking apparatus is an apparatus for parking the vehicle 1 and includes a palette 10, main structure 20, elevator apparatus, and cage support apparatus 70.

The elevator apparatus is comprised of a lift cage 30, wire 40, winding apparatus 50 and coupling mechanism 60.

The palette 10 is a structure on which it is possible to put the vehicle 1. The palette is substantially quadrangular-shaped as viewed from above. The palette has wheels along the short sides and is capable of moving in a direction along the short sides. A vehicle then moves under its own propulsion in a direction along the long side of the palette 10 so as to mount the palette 10. The wheels of the palette 10 roll onto palette rails 33 and a storage rack 21 provided at the lift cage 30 described later so as to be capable of moving between the lift cage 30 and the storage rack 21.

When the vehicle 1 is being parked, the vehicle 1 mounts the palette 10 and is stored in the storage rack 21.

The elevator shaft H is a space extending in a vertical direction including the vehicle loading and unloading area S.

For example, with the parking apparatus built-into the ground, the vehicle loading and unloading area S is provided at the ground, and the elevator shaft H is provided above the vehicle loading and unloading area S.

When the vehicle 1 is loaded and unloaded, the palette 10 goes onto the lift cage 30, the lift cage 30 goes up the elevator shaft H, and the palette moves laterally between the vehicle loading and unloading area S and the storage rack 21.

The main structure 20 is a framework of the building for the vehicle parking apparatus, and consists of N storage racks 21, columns 22, beams 23, and 2N support members 24.

The plurality of storage racks 21 are racks lined up vertically that are each capable of storing a vehicle 1.

For example, storage rack 21 has palette rails that the wheels of the palette 10 roll on.

Normally, the storage racks 21 are arranged to the left and right of the elevator shaft H.

The columns 22 is a structural member for supporting the storage rack 21.

The beams 23 are structural members connected to the left and right of the columns 22.

The support members 24 are members for supporting the lift cage 30 using the action of cage support apparatus 70 described later in order to position the lift cage 30 laterally with respect to s storage rack 21 within the elevator shaft H.

The support members 24 are fixed to the columns 22 established to the left and right of the elevator shaft H.

The lift cage 30 is an apparatus on which the vehicle 1 can be put, and is configured from the lift cage structure 31, transfer apparatus 32, and palette rail 33.

The lift cage structure 31 is a structure made from longitudinal lateral members 31*a* arranged in a rectangular shape as viewed from above and vertical members 31*b* extending in a vertical direction fixed to the four corners of the rectangle.

The transfer apparatus 32 are apparatus capable of transferring the palette 10 between the upper portion of the lift cage 30 and a storage rack 21.

For example, the transfer apparatus 32 has a clamp driven by a chain enabling movement to the left and right. The transfer apparatus 32 moves the clamp engaged with the palette 10 in a direction to the left and right, moves the palette 10 from the storage rack 21 to the palette rails 33, and again from the palette rails 33 to the storage rack 21.

The palette rails 33 are a pair of longitudinal members the wheels of the palette 10 are capable of rolling on. The palette rails 33 extending in the left and right direction are fixed to the lateral members 31*a* of the lift cage structure 31.

The wire 40 is a mechanical element capable of hanging the lift cage 30 within the elevator shaft H via the coupling mechanism 60 described later.

One end of the wire 40 is connected to the vertical members 31*b* of the lift cage 30 via a coupling mechanism 60.

The wire 40 is wound onto the winding apparatus 50. One end of the wire 40 moves up and down within the elevator shaft H. The other end of the wire 40 moves up and down along the main structure 20.

For example, three wires are taken to be one group. One end of four groups of wires is then coupled to the vertical members 31*b* via each respective coupling mechanism 60. A total of twelve wires are then wound around the sheave of the winding apparatus 50. A counterweight 56 is coupled to the other end of the total of twelve wires.

The winding apparatus 50 is apparatus capable of winding the wire 40 up and down within the elevator shaft H, and is constituted by a winding sheave 51, drive sheave 52, idle sheave 53, decelerator 54, winding motor 55, and counterweight 56.

The winding sheave 51 is a sheave for winding the wire 40 hanging from the four corners of the lift cage 30 at the upper end of the elevator shaft H so as to pass through the drive sheave 52.

The drive sheave 52 is a sheave for winding the wire 40 up and down using frictional force generated as a result of winding around the wire 40. When the drive sheave 52 is rotated, the frictional force pulls the wire 40.

The idle sheave 53 idles next to the drive sheave 52, and is a sheave for making the winding angle of the wire large at the drive sheave 52.

The decelerator 54 is a mechanical element for decelerating rotation of an input shaft, and for causing an output shaft coupled to the drive sheave 52 to rotate.

The winding motor 55 is a mechanical element for causing the input shaft of the decelerator 54 to rotate.

The coupling mechanism 60 is a mechanism for coupling one end of the wire 40 to the lift cage 30 and is comprised of a first coupling member 61, second coupling member 62, urging mechanism 63 and detection means 64.

The first coupling member 61 is capable of coming into contact with the second coupling member 62 (described later) from the lower side and is a member capable of relative movement in a downward direction from a position of making contact with the second coupling member 62. The first coupling member 61 is fixed to one end of the wire 40.

For example, the first coupling member 61 is composed of a first block 61*a*, a rod 61*b*, and a wire engaging member 61*c*.

The first block 61*a* is a six-sided block fixed to the lower end of the rod 61*b*.

The rod 61*b* is a rod extending vertically and is guided by a second coupling member 62 described later so as to move freely in a vertical direction.

The wire engaging member 61*c* is a member fixed to an upper end of the rod 61*b* and is coupled to an end of the wire 40.

The first block 61*a* supports approximately ¼ of the gross weight of the lift cage 30.

The gross weight of the lift cage 30 when empty is the weight of a single lift cage 30.

The gross weight of the lift cage 30 when loaded is the sum total of the weight of a lift cage 30 and the weight of a vehicle.

Force acting on the first block 61*a* is transmitted to the wire 40 via rod 61*b* and wire engaging member 61*c*.

The second coupling member 62 is fixed to the lift cage 30.

For example, the second coupling member 62 is composed of a second lower section block 62*a*, a second upper section block 62*b*, and a cylindrical member 62*c*.

The second lower section block 62*a* is a block fixed to one of the vertical members 31*b* of the lift cage 30. The second lower section block 62*a* is provided with a lower section through-hole passing through to a lower section in a vertical direction. A resilient spring 63*a* passes in a vertical direction through the lower section through-hole. Further, the upper surface of the first block 61*a* is capable of coming into contact with the lower surface of the second lower section block 62*a*. For example, the four corners of the upper surface of the quadrilateral of the first block come into contact with the second lower section block 62*a*.

The second upper section block 62*b* is arranged on the upper section of the second lower section block 62*a* and is fixed to one of the vertical members 31*b* of the lift cage 30. The second upper section block 62*b* is provided with an upper section through-hole in a vertical direction. The rod 61*b* passes through the upper section through-hole and freely moves in a vertical direction.

The cylindrical member 62*c* is a cylindrical member from which the second lower section block 62*a* and the second upper section block 62*b* are hung. The resilient spring 63*a* described later is housed in a space of the cylindrical member 62*c*.

The lower surface of the second lower section block 62*a* therefore comes into contact with the upper surface of the first block 61*a*.

For convenience of description, in FIG. 5 and FIG. 6, the lower surface of the second lower section block 62*a* is described as the reference position L.

The second coupling member 62 is in contact with the first coupling member 61 from the lower side while the upper surface of the first block 61*a* is positioned at a prescribed reference position L.

The second coupling member 62 can freely move relatively to the lower side of the first coupling member 61 while the upper surface of the first block 61*a* is positioned to the lower side of the prescribed reference position L.

An urging mechanism 63 is a mechanism where a prescribed urging force acts in a downward direction on the first coupling member 61.

For example, the urging mechanism 63 has a resilient spring 63*a* causing elastic force generated as a result of a change from a free length to a predetermined length to act on the first coupling member 61 in a downward direction, and causing elastic force to act on a second coupling member 62 in an upward direction.

For example, a pre-compressed resilient spring 63*a* is housed within the cylindrical member 62*c*. The upper end of the resilient spring 63*a* comes into contact with the lower end of the second upper section block 62*b*, and a compressive force of the resilient spring 63*a* acts in an upward direction on the second upper section block 62*b*. The lower end of the resilient spring 63*a* comes into contact with the upper section of the first block 61*a*, and the pre-compression force of the resilient spring 63*a* acts in a downward direction on the first coupling member 61.

It is preferable for the prescribed urging force to be smaller than the downward force acting on the second coupling member 62 due to the weight of the lift cage 30 while the lift cage 30 that does not have a vehicle 1 on it is supported only by the suspension force of the wire 40.

The four coupling mechanisms 60 are coupled to each of the vertical members 31*b* on the four corners of the lift cage 30 and in the event that the weight W0 of a lift cage that is not holding a vehicle 1 acts in a substantially uniform manner on the four coupling mechanisms 60, the pre-compression force of the resilient spring 63*a* is made to be smaller than ¼×W0.

In doing this, in the event that the lift cage 30 is suspended only by the force of suspension of the wire 40, the upper surface of the first block 61*a* comes into contact with the lower surface of the second lower section block 62*a*. In the event that the lift cage 30 is supported at the main structure 20 due to the action of a cage support apparatus 70 (described later), the upper surface of the first block 61*a* comes away from the lower surface of the second lower section block 62*a*, and a pulling force corresponding to the compression force of the resilient spring 63*a* acts on the wire 40.

Detection means 64 is means for detecting that the first coupling member 61 has moved relatively downwards from the position of making contact with the second coupling member 62. When the detection means 64 detects relative movement of the first coupling member 61, the winding apparatus 50 stops lowering of the wire 40.

For example, the detection means 64 is a limit switch adjusted in such a manner that the point of contact goes on and off when the first block 61*a* moves by just dL to the lower side from the second lower section block 62*a*.

In doing so, in the event that the lift cage 30 is supported by the main structure 20 due to the action of the cage support apparatus 70 described later, the first coupling member 61 is stopped when the upper surface of the first block 61*a* is at a lowered position away by just dL from the lower surface of the second lower section block 62*a*.

Therefore, in the event that the lift cage 30 is supported at the main structure 20 due to the action of the cage support apparatus 70 described later, urging force of the urging means always acts on the wire 40, and stability of operation of the drive sheave 52 is maintained.

The cage support apparatus 70 is an apparatus for supporting the lift cage 30 using the main structure 20 while the lift cage is lined up horizontally with one storage rack 21 of the plurality of storage racks.

For example, the cage support apparatus 70 is comprised of a swing member 71, a swing support member 72, a latch member 73, an extension spring 74, a swing cable 75, a support posture confirmation switch 76, a retraction posture confirmation switch 77, and a swing actuator 78.

The swing member 71 is a substantially L-shaped member capable of swinging between a support posture and a retraction posture taking a central section as a center of swing. At the support posture, one end of the L-shape of the swing member 71 projects to the outside of a vertical member 31*b*, and the other end of the L-shape of the swing member 71 comes into contact with the latch member 73. One end of the L-shape of the swing member 71 is capable of latching with the upper surface of the support member 34 of the main structure 20.

When the swing member 71 latches with the support member 34, force in an upward direction due to the weight of the lift cage acts on one end of the L-shape of the swing member 71 and the latch member supports the other end of the L-shape of the swing member 71. In the retraction posture, one end of the L-shape of the swing member 71 is withdrawn to inside the vertical member 31*b*.

The swing support member 72 is a member for supporting the swing member 71 in a freely swinging manner to as to enable rotation about a central section, and is fixed to the vertical member 31*b*.

The latch member 73 is a member supporting the swing member 71 at the support position and is fixed to the vertical member 31*b*.

The extension spring 74 is a spring that extends in such a manner as to put the swing member 71 into the retracted position, and has one end fixed to the swing member 71, and the other end fixed to the vertical member 31*b*.

The swing cable 75 is a cable capable of extending in such a manner as to put the swing member 71 into a support posture, with one end fixed to the swing member 71, and the other end fixed to a swing actuator 78 described later.

The support posture confirmation switch 76 is a limit switch for putting the contact point on and off when the swing member 71 is in the support posture.

The retraction posture confirmation switch 77 is a limit switch for putting the contact point on and off when the swing member 71 is in the retracted posture.

The swing actuator 78 is an actuator capable of pulling the swing cable 75. The swing actuator 78 is fixed to the lift cage 30.

When the swing actuator 78 pulls the other end of the swing cable 75, the swing member 71 adopts the support posture, and the contact point of the support posture confirmation switch 76 is put on and off. When the swing actuator loosens the other end of the swing cable 75, the swing member 71 adopts the retraction posture, and the contact point of the retraction posture confirmation switch 77 is put on and off.

Next, a description is given based on the drawings of the operation of a parking apparatus of a first embodiment of the present invention.

Figure 7A:
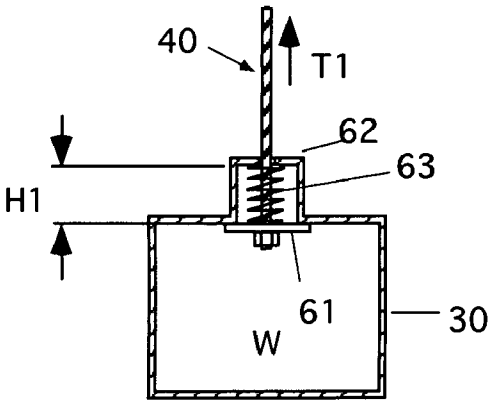
FIG. 7A to 7C are views of the operation of a parking apparatus of a first embodiment of the present invention.
Figure 7B:
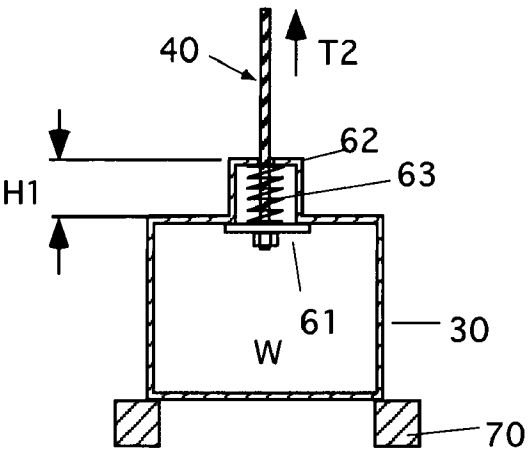
Figure 7C:
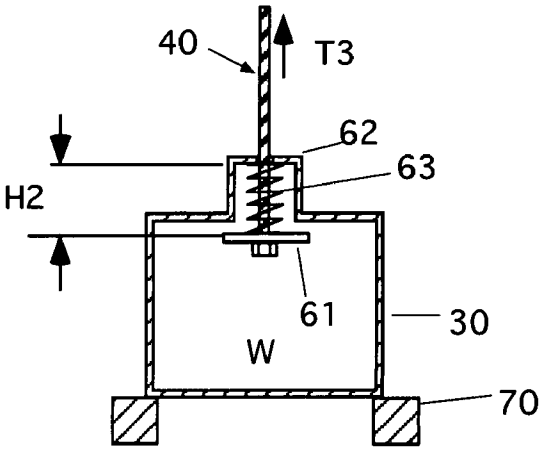

FIG. 7A to 7C are views of the operation of a parking apparatus of a first embodiment of the present invention.

For ease of description, a description is given where a plurality of wires are typified by one wire, and four coupling mechanisms are typified by a single coupling mechanism.

The urging force of the urging mechanism 63 is a pre-compression force of F1 when pre-compression takes place with the length of the resilient spring being taken to be H1.

The pre-compressive force F1 is smaller than the gross weight W of the lift cage 30 when empty.

The gross weight W of the lift cage 30 when there is no load is W0.

When loaded, the gross weight W of the lift cage 30 is W0+W1. Here, W1 is the total weight of the palette 10 and the vehicle 1.

FIG. 7A schematically shows the state when the wire 40 lifts the lift cage 30 up and down in the elevator shaft H.

The wire 40 suspends the gross weight W of the lift cage 30. The first coupling member 61 comes into contact with the second coupling member 62 from the lower side. The urging mechanism (resilient spring) 63 is compressed so as to have a length H1.

In this state, the gross weight W of the lift cage is transmitted to the wire 40 via the first coupling member 61 and the second coupling member 62.

The relationship between the tension T1 of the wire and the gross weight W of the lift cage 30 at this time is as follows:

$$T1=W$$

When the wire raises and lowers the lift cage 30 along the elevator shaft H, urging force (elastic force) of the urging mechanism (resilient spring) is not subjected to the influence of the movement of the lift cage 30.

FIG. 7B gives the state where the lift cage 30 suspended from the wire 40 is landing on the main structure 20 by the cage support apparatus 70.

When the pulling force acting on the wire 40 becomes smaller than W, the support force provided by the cage support apparatus 70 becomes larger.

The relationship between the tension T2 of the wire, the gross weight W of the lift cage 30 and the support force P of the main structure at this time is as follows:

$$T2=W-P$$

While T2 is larger than the pre-compression force F1, the first coupling member 61 comes into contact with the second coupling member 62 from the lower side. The urging mechanism (resilient spring) 63 is then compressed so as to have a length H1.

FIG. 7C gives the state where the lift cage 30 suspended from the wire 40 lands on the main structure 20 by the cage support apparatus 70.

The first coupling member 61 is then drawn away downwards from the second coupling member 62 and is stopped.

Tension T3 acting on the wire 40 is equal to the pre-compressive force F1 of the urging mechanism (resilient spring).

$$T3=F1$$

At this time, the force P the main structure 20 supports the lift cage 30 with using the cage support apparatus is as follows.

$$P=W-F1$$

Here, the actual pre-compressive force of the urging mechanism (resilient spring) is a value smaller by just dL×K as a result of the length extending but this may be ignored for the purposes of description. Here, K is the spring constant of the resilient spring.

There is a change from the state shown in FIG. 7C to the state shown in FIG. 7A while the lift cage 30 supported at the main structure 20 by the cage support apparatus 70 is suspended only by the wire 40.

As a result of this occurring, the tension on the wire changes from T3 to T1 but does not fall below at least F1.

The tension of the wire 40 wrapped around the drive sheave 52 of the winding apparatus 50 is therefore maintained at a fixed value or more, and the winding apparatus 50 is always stable during winding up or winding down.

Figure 8:
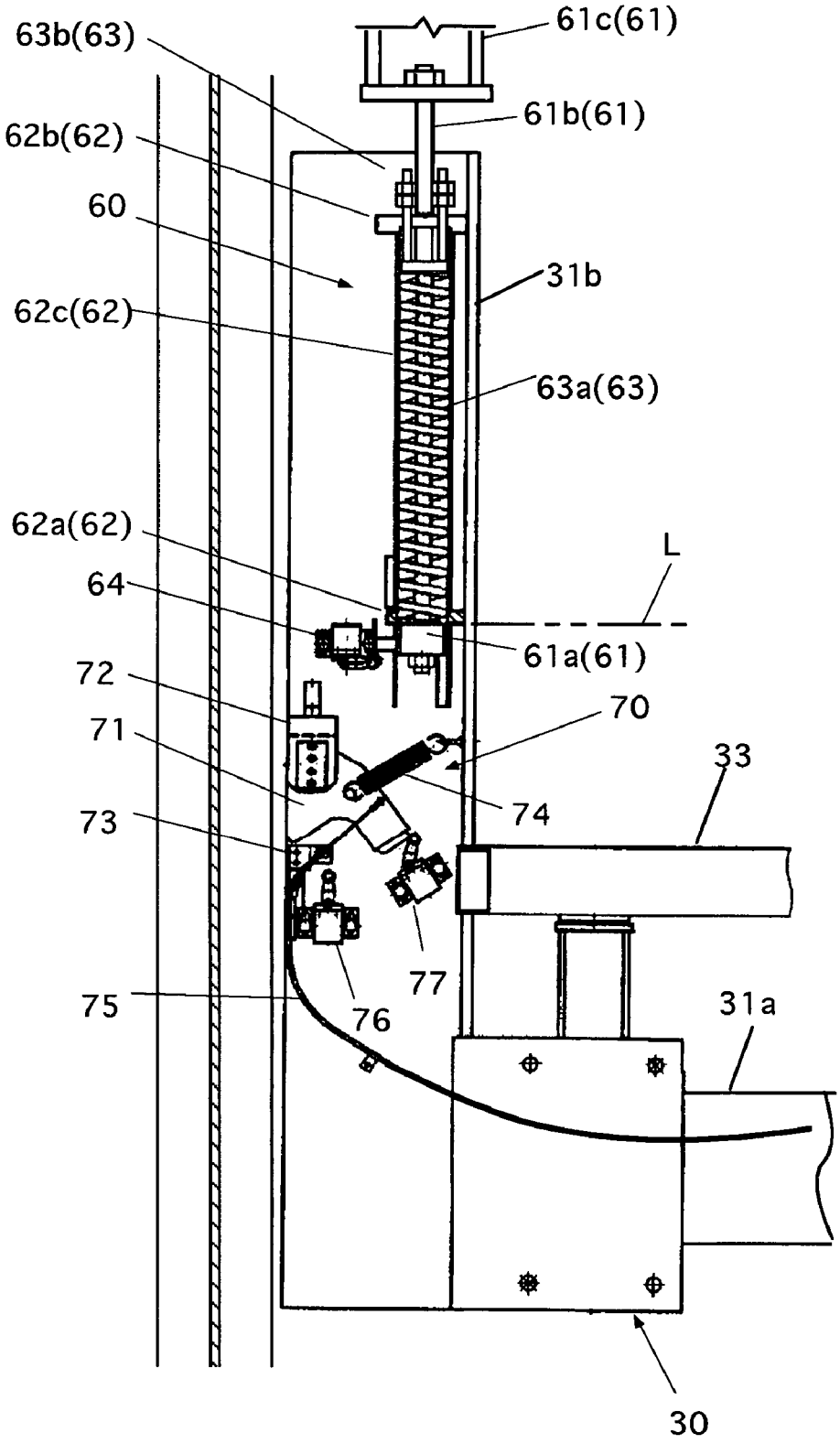
FIG. 8 is a partial view of a parking apparatus of a second embodiment of the present invention.
Figure 9:
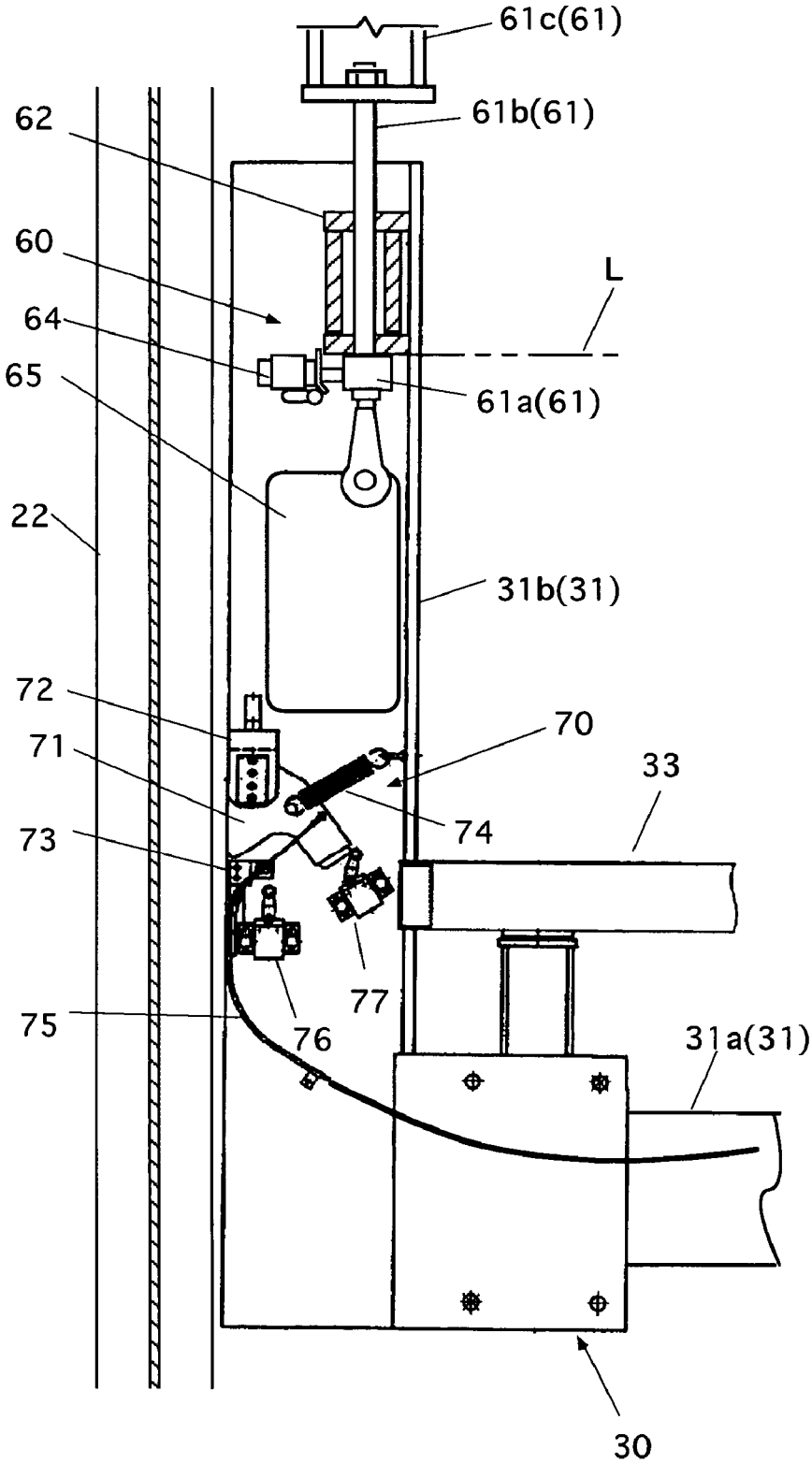
FIG. 9 is a partial view of a parking apparatus of a third embodiment of the present invention.

Next, a description is given of a parking apparatus of a second embodiment of the present invention based on FIG. 8.

The vehicle parking apparatus is an apparatus for parking the vehicle 1, and is comprised of the palettes 10, main structure 20, lift cage 30, wire 40, winding apparatus 50, coupling mechanisms 60, and cage support apparatus 70.

The structure of the vehicle parking apparatus of the second embodiment is the same as that of the vehicle parking apparatus of the first embodiment with the exception of the structure of the coupling mechanism 60, and only points of difference will be described.

The coupling mechanism 60 is a mechanism for coupling one end of the wire 40 to the lift cage 30 and is comprised of a first coupling member 61, second coupling member 62, urging mechanism 63 and detection means 64.

The structure of the coupling mechanism 60 is the same as that of the vehicle parking apparatus of the first embodiment with the exception of the structure of the urging mechanism 63, and only points of difference will be described.

An urging mechanism 63 is a mechanism where a prescribed urging force acts in a downward direction on the first coupling member 61.

For example, the urging mechanism 63 has a resilient spring 63*a* causing elastic force generated as a result of a change from a free length to a predetermined length to act on the first coupling member 61 in a downward direction, causing elastic force to act on a second coupling member 62 in an upward direction, and an adjustment mechanism 63*b* capable of adjusting the predetermined length of the resilient spring.

The structure of the resilient spring 63*a* is the same as for the vehicle parking apparatus of the first embodiment.

For example, the adjustment mechanism 63*b* is a pressing bolt provided at the second upper section block 62*b*.

When the pressing bolt is screwed in, the length of pre-compression of the resilient spring is changed, and it is possible to make the pre-compression a desired value.

Force acting at the coupling mechanisms provided at the four corners of the lift cage 30 due to the weight of the lift cage 30 is not always equal. Further, there may be variations in the parameters of the resilient spring due to variations in the manufacturing processes.

When the adjustment mechanism 63*b* is present, it is possible to adjust the urging force set at each of the coupling mechanisms 60 provided at the four corners to the most appropriate values.

The operation of the vehicle parking apparatus of the second embodiment of the present invention is the same as the operation of the vehicle parking apparatus of the first embodiment and is therefore not described.

Next, a description is given of a parking apparatus of a third embodiment of the present invention based on FIG. 9 and FIG. 10A to 10C.

The vehicle parking apparatus is an apparatus for parking the vehicle 1, and is comprised of the palettes 10, main structure 20, lift cage 30, wire 40, winding apparatus 50, coupling mechanisms 60, and cage support apparatus 70.

The structure of the vehicle parking apparatus of the third embodiment of the present invention is the same as that of the vehicle parking apparatus of the first embodiment with the exception of the structure of the coupling mechanism 60, and only points of difference will be described.

The coupling mechanism 60 is a mechanism for coupling one end of the wire 40 to the lift cage 30 and is comprised of a first coupling member 61, second coupling member 62, urging mechanism 63 and detection means 64.

The structure of the coupling mechanism 60 is the same as that of the vehicle parking apparatus of the first embodiment with the exception of the structure of the urging mechanism 63, and only points of difference will be described.

An urging mechanism 63 is a mechanism where a prescribed urging force acts in a downward direction on the first coupling member 61.

For example, the urging mechanism 63 has a weight 65 suspended from the first coupling member 61.

The weight of the weight 65 acts as an urging force in a downward direction on the first coupling member.

The weight of the weight provides the wire tension necessary to enable the winding apparatus 50 to wind up and wind down the wire 40 in a stable manner.

Next, a description is given based on the drawings of the operation of the parking apparatus of the third embodiment of the present invention.

Figure 10C:
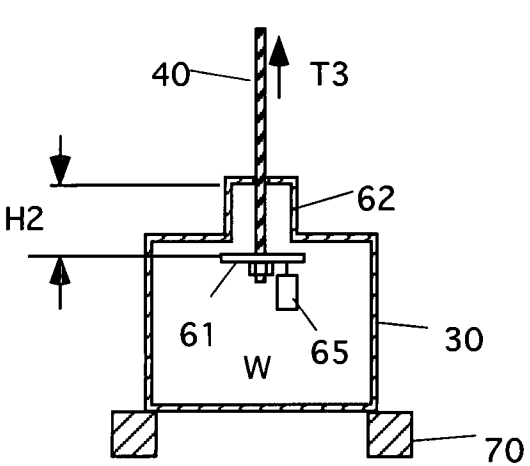
FIG. 10A to 10C are views of the operation of a parking apparatus of a third embodiment of the present invention.
Figure 10B:
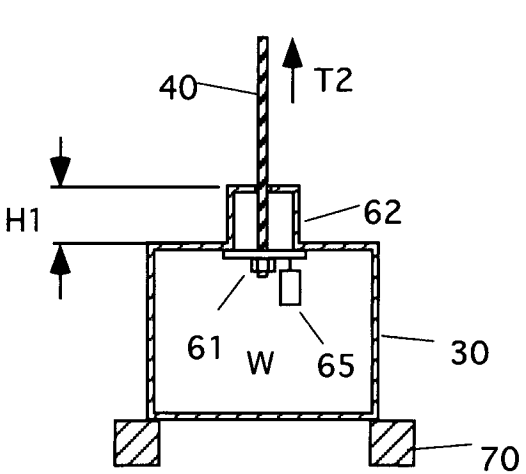
Figure 10A:
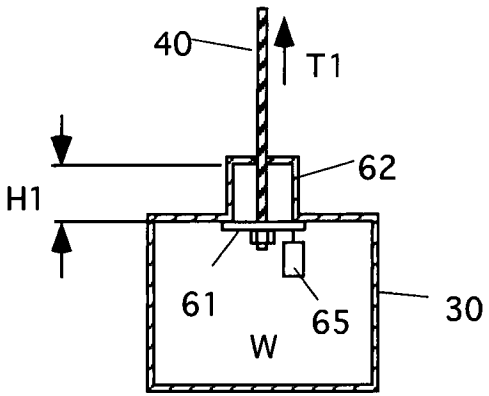

FIG. 10A to 10C are views of the operation of a parking apparatus of a third embodiment of the present invention.

For ease of description, a description is given where a plurality of wires are typified by one wire, and four coupling mechanisms are typified by a single coupling mechanism.

The urging force of the urging mechanism 63 is the weight of a weight 65.

The gross weight W of the lift cage 30 when there is no load is W0.

When loaded, the gross weight W of the lift cage 30 is W0+W1. Here, W1 is the total weight of the palette 10 and the vehicle 1.

In this embodiment, the gross weight W of the lift cage 30 includes a weight F2 of the weight 65.

FIG. 10A schematically shows the state when the wire 40 lifts the lift cage 30 up and down in the elevator shaft.

The wire 40 suspends the gross weight W of the lift cage 30. The first coupling member 61 comes into contact with the second coupling member 62 from the lower side.

In this state, the gross weight W of the lift cage is transmitted to the wire 40 via the first coupling member 61 and the second coupling member 62.

The relationship between the tension T1 of the wire and the gross weight W of the lift cage 30 at this time is as follows:

$$T1=W$$

When the wire raises and lowers the lift cage 30 along the elevator shaft H, urging force of the urging apparatus (weight) is not subjected to the influence of the movement of the lift cage 30.

FIG. 10B gives the state where the lift cage 30 suspended from the wire 40 is landing on the main structure 20 by the cage support apparatus 70.

When the pulling force acting on the wire 40 becomes smaller than W, the support force provided by the cage support apparatus 70 becomes larger.

The relationship between the tension T2 of the wire, the gross weight W of the lift cage 30 and the support force P of the main structure 20 at this time is as follows:

$$T2=W-P$$

The first coupling member 61 comes into contact with the second coupling member 62 from the lower side while T2 is larger than the weight F2 of the weight.

FIG. 10C gives the state where the lift cage 30 suspended from the wire 40 lands on the main structure 20 by the cage support apparatus 70.

The first coupling member 61 is then drawn away downwards from the second coupling member 62 and is stopped.

Tension T3 acting on the wire 40 is equal to the weight F2 of the weight.

$$T3=F2$$

At this time, the force P the main structure 20 supports the lift cage 30 with using the cage support apparatus is as follows.

$$P=W$$

There is a change from the state shown in FIG. 10C to the state shown in FIG. 10A while the lift cage 30 supported at the main structure 20 by the cage support apparatus 70 is suspended only by the wire 40.

As a result of this occurring, the tension on the wire changes from T3 to T1 but does not fall below at least F2.

The tension of the wire 40 wrapped around the drive sheave 52 of the winding apparatus 50 is therefore maintained at a fixed value or more, and the winding apparatus 50 is always stable during winding up or winding down.

If the vehicle parking apparatus and elevator apparatus for a vehicle parking apparatus of the aforementioned embodiments are employed, the following results are achieved.

At the vehicle parking apparatus constituted by the palettes 10, main structure 20, lift cage 30, wire 40, and winding apparatus 50, the coupling mechanisms 60 is comprised of the first coupling member 61 fixed to the wire, the second coupling member 62 fixed to the lift cage 30, and the urging mechanism 63. The first coupling member 61 is capable of coming into contact with the second coupling member 62 from the lower side, and is capable of relative movement in a downward direction from a position of making contact with the second coupling member 62, with the urging mechanism 63 acting in a downward direction at the first coupling member 61. The lift cage 30 on which the vehicle 1 is mounted is suspended by the wire 40 so that when the winding apparatus 50 is wound up and wound down, the lift cage 30 moves along the storage rack 21. Further, when the second coupling member 62 comes into contact with the first coupling member 61, suspension force of the wire 40 supports the lift cage 30 via the first coupling member 61 and the second coupling member 62. When the second coupling member 62 comes away from the first coupling member 61, the urging force subjects the wire 40 to tension via the first coupling member 61 and the wire is prevented from slackening.

Further, while the vehicle 1 loaded on the palette 10 is moved between the lift cage 30 and the storage rack 21, the change in extension of the wire is small even if the gross weight of the lift cage changes substantially and the winding apparatus 50 may therefore operate in a stable manner.

In the event that the winding apparatus 50 winds the wire onto the drive shave and winds the wire up and down using frictional force generated by the tension of the wire, it is possible to keep the tension of the wire a fixed value or more so that stable driving is possible.

If winding apparatus of the above format is adopted, it is possible to increase the number of storage racks lined up vertically, so that it is not necessary to increase the size of the drive sheave even if the length of the wire is long, and the winding apparatus can be made compact in size.

Further, as the prescribed urging force is smaller than the force acting on the second coupling member 62 due to the weight of the lift cage 30 while a lift cage 30 without a vehicle 1 mounted is supported only by suspension force of the wire 40, and while the lift cage 30 is supported only by the suspension force of the wire 40, the first coupling member 61 is made to move upwards against the urging force so as to come into contact with the second coupling member, and then the suspension force of the wire is transmitted to the lift cage via the first coupling member and the second coupling member.

Further, the urging mechanism is constructed from a resilient spring fitted between the first coupling member and the second coupling member. It is therefore possible to construct an urging mechanism using a lightweight, simple configuration.

Further, it is possible to adjust the urging force by provided an adjustment mechanism for adjusting the pre-compressive force of the resilient spring.

Moreover, urging force is generated by the weight 65. It is therefore possible for urging force to be made to act on the first coupling member 61 with a simple configuration.

Further, by adopting a configuration where the winding apparatus 50 stops winding down the wire 40 when it is detected that the first coupling member 61 has moved relatively from a position of contact with the second coupling member 62, the wire 40 is prevented from being wound down to a greater extent than is necessary.

Further, the cage support apparatus 70 is configured so that the lift cage 30 is supported by the main structure 20 while the lift cage 30 is stopped in the elevator shaft H, and the lift cage 30 therefore does not move up and down. Further, during this time, an urging force acts on the wire, and change in suspension force the lift cage is subjected to by the wire 40 are small while the cage support apparatus 70 releases support of the lift cage 30.

The invention has been described with respect to preferred embodiments. It will be apparent to those skilled in the art that the foregoing description is only an example of embodiments of the invention, and that other embodiments of the invention can be devised which do not depart from the spirit of the invention as disclosed herein. Accordingly, the invention is to be limited in scope only by the attached claims.

A description is given where the resilient spring is a compression spring but this is by no means limiting and a tensile string may also be employed.

Further, a description is given taking a limit switch operating due to movement of the first coupling member as detection means but this is by no means limiting, and, for example, it is also possible to use a limit switch for detecting that a swing member has collided with the support member and then stop the winding apparatus after operation of the contact point of the limit switch.

Moreover, the cage support apparatus is such that the swing member is mounted on the support member but the swing member may also be substituted with a sliding member sliding to the left and right with the sliding member inserting into the support member.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vehicle parking apparatus, comprising:

a main structure having a plurality of storage racks vertically aligned;

a lift cage;

a coupling mechanism having a second coupling member, a first coupling member comprising a first block capable of making direct contact with the second coupling member from a lower side and capable of relative movement in a downward direction from a position of making contact with the second coupling member, and an urging mechanism causing a prescribed urging force to act in a downward direction on the first coupling member;

a wire capable of suspending the lift cage in an elevator shaft next to the storage racks via the coupling mechanism; and a winding apparatus capable of winding the wire up and down, wherein the first coupling member is fixed to one end of the wire, and the second coupling member is fixed to the lift cage, wherein an entirety of the first block is disposed below the one end of the wire, and wherein the coupling mechanism moves back-and-forth between a first position in which the first coupling member makes direct contact with the second coupling member from a lower side, and a second position in which the first coupling member is moved in a relatively downward direction from the first position, and in which the urging mechanism causes the prescribed urging force to act in the downward direction on the first coupling member.

2. The vehicle parking apparatus of claim 1, further comprising detection means for detecting when the first coupling member moves in a relative manner downwards from a position of making contact with the second coupling member, wherein when the detection means detects relative movement of the first coupling member, the winding apparatus stops winding down of the wire.

3. The vehicle parking apparatus of claim 1, further comprising a cage support apparatus causing the lift cage to be supported by the main structure while the lift cage is horizontally lined up with one storage rack of the plurality of storage racks.

4. A vehicle parking apparatus, comprising:

a main structure having a plurality of storage racks vertically aligned;

a lift cage;

a coupling mechanism having a second coupling member, a first coupling member comprising a first block capable of making direct contact with the second coupling member from a lower side and capable of relative movement in a downward direction from a position of making contact with the second coupling member, and an urging mechanism causing a prescribed urging force to act in a downward direction on the first coupling member;

a wire capable of suspending the lift cage in an elevator shaft next to the storage racks via the coupling mechanism; and a winding apparatus capable of winding the wire up and down, wherein the first coupling member is fixed to one end of the wire, and the second coupling member is fixed to the lift cage, wherein an entirety of the first block is disposed below the one end of the wire, and wherein the prescribed urging force is smaller than a downward force acting on the second coupling member due to the weight of the lift cage when the lift cage, having no vehicle therein, is supported only by the suspension force of the wire.

5. A vehicle parking apparatus, comprising:

a main structure having a plurality of storage racks vertically aligned;

a lift cage;

a coupling mechanism having a second coupling member, a first coupling member comprising a first block capable of making direct contact with the second coupling member from a lower side and capable of relative movement in a downward direction from a position of making contact with the second coupling member, and an urging mechanism causing a prescribed urging force to act in a downward direction on the first coupling member;

a wire capable of suspending the lift cage in an elevator shaft next to the storage racks via the coupling mechanism; and a winding apparatus capable of winding the wire up and down, wherein the first coupling member is fixed to one end of the wire, and the second coupling member is fixed to the lift cage, wherein an entirety of the first block is disposed below the one end of the wire, and wherein the urging mechanism has a resilient spring causing an elastic force generated as a result of a change to a predetermined length to act on the first coupling member in a downward direction, and causing the elastic force to act on a second coupling member in an upward direction.

6. A vehicle parking apparatus, comprising:

a main structure having a plurality of storage racks vertically aligned;

a lift cage;

a coupling mechanism having a second coupling member, a first coupling member comprising a first block capable of making direct contact with the second coupling member from a lower side and capable of relative movement in a downward direction from a position of making contact with the second coupling member, and an urging mechanism causing a prescribed urging force to act in a downward direction on the first coupling member;

a wire capable of suspending the lift cage in an elevator shaft next to the storage racks via the coupling mechanism; and a winding apparatus capable of winding the wire up and down, wherein the first coupling member is fixed to one end of the wire, and the second coupling member is fixed to the lift cage, wherein an entirety of the first block is disposed below the one end of the wire, and wherein the urging mechanism has a resilient spring causing an elastic force generated as a result of a change to a predetermined length so as to act on the first coupling member in a downward direction, causing the elastic force to act on the second coupling member in an upward direction, and an adjustment mechanism capable of adjusting the predetermined length of the resilient spring.

7. A vehicle parking apparatus, comprising:

a main structure having a plurality of storage racks vertically aligned;

a lift cage;

a coupling mechanism having a second coupling member, a first coupling member comprising a first block capable of making direct contact with the second coupling member from a lower side and capable of relative movement in a downward direction from a position of making contact with the second coupling member, and an urging mechanism causing a prescribed urging force to act in a downward direction on the first coupling member;

a wire capable of suspending the lift cage in an elevator shaft next to the storage racks via the coupling mechanism; and a winding apparatus capable of winding the wire up and down, wherein the first coupling member is fixed to one end of the wire, and the second coupling member is fixed to the lift cage, wherein an entirety of the first block is disposed below the one end of the wire, and wherein the urging mechanism has a weight suspended from the first coupling member.

8. An elevator apparatus for lifting a vehicle up and down in an elevator shaft, comprising:

a lift cage;

a coupling mechanism having a second coupling member, a first coupling member comprising a first block capable of making direct contact with the second coupling member from a lower side and capable of relative movement in a downward direction from a position of making contact with the second coupling member, and an urging mechanism causing a prescribed urging force to act in a downward direction on the first coupling member;

a wire capable of suspending the lift cage in an elevator shaft via the coupling mechanism; and a winding apparatus capable of winding the wire up and down, wherein the first coupling member is fixed to one end of the wire, and the second coupling member is fixed to the lift cage, wherein an entirety of the first block is disposed below the one end of the wire, and wherein the coupling mechanism moves back-and-forth between a first position in which the first coupling member makes direct contact with the second coupling member from a lower side, and a second position in which the first coupling member is moved in a relatively downward direction from the first position, and in which the urging mechanism causes the prescribed urging force to act in the downward direction on the first coupling member.

9. The elevator apparatus of claim 8, further comprising a detection means for detecting when the first coupling member moves in a relative manner downwards from a position of making contact with the second coupling member, wherein when the detection means detects relative movement of the first coupling member, the winding apparatus stops winding down of the wire.

10. The elevator apparatus of claim 8, further comprising a cage support apparatus for causing the lift cage to be supported by a main structure arranged along the elevator shaft while the lift cage is stopped in the elevator shaft.

11. An elevator apparatus for lifting a vehicle up and down in an elevator shaft, comprising:

a lift cage;

a coupling mechanism having a second coupling member, a first coupling member comprising a first block capable of making direct contact with the second coupling member from a lower side and capable of relative movement in a downward direction from a position of making contact with the second coupling member, and an urging mechanism causing a prescribed urging force to act in a downward direction on the first coupling member;

a wire capable of suspending the lift cage in an elevator shaft via the coupling mechanism; and a winding apparatus capable of winding the wire up and down, wherein the first coupling member is fixed to one end of the wire, and the second coupling member is fixed to the lift cage, wherein an entirety of the first block is disposed below the one end of the wire, and wherein the prescribed urging force is smaller than a downward force acting on the second coupling member due to the weight of the lift cage, when the lift cage, having no vehicle therein, is supported only by the suspension force of the wire.

12. An elevator apparatus for lifting a vehicle up and down in an elevator shaft, comprising:

a lift cage;

a coupling mechanism having a second coupling member, a first coupling member comprising a first block capable of making direct contact with the second coupling member from a lower side and capable of relative movement in a downward direction from a position of making contact with the second coupling member, and an urging mechanism causing a prescribed urging force to act in a downward direction on the first coupling member;

a wire capable of suspending the lift cage in an elevator shaft via the coupling mechanism; and a winding apparatus capable of winding the wire up and down, wherein the first coupling member is fixed to one end of the wire, and the second coupling member is fixed to the lift cage, wherein an entirety of the first block is disposed below the one end of the wire, and wherein the urging mechanism has a resilient spring causing an elastic force generated as a result of a change to a predetermined length to act on the first coupling member in a downward direction, and causing the elastic force to act on the second coupling member in an upward direction.

13. An elevator apparatus for lifting a vehicle up and down in an elevator shaft, comprising:

a lift cage;

a coupling mechanism having a second coupling member, a first coupling member comprising a first block capable of making direct contact with the second coupling member from a lower side and capable of relative movement in a downward direction from a position of making contact with the second coupling member, and an urging mechanism causing a prescribed urging force to act in a downward direction on the first coupling member;

a wire capable of suspending the lift cage in an elevator shaft via the coupling mechanism; and a winding apparatus capable of winding the wire up and down, wherein the first coupling member is fixed to one end of the wire, and the second coupling member is fixed to the lift cage, wherein an entirety of the first block is disposed below the one end of the wire, and wherein the urging mechanism has a resilient spring causing an elastic force generated as a result of a change to a predetermined length so as to act on the first coupling member in a downward direction, causing elastic force to act on the second coupling member in an upward direction, and an adjustment mechanism capable of adjusting the predetermined length of the resilient spring.

14. An elevator apparatus for lifting a vehicle up and down in an elevator shaft, comprising:

a lift cage;

a coupling mechanism having a second coupling member, a first coupling member comprising a first block capable of making direct contact with the second coupling member from a lower side and capable of relative movement in a downward direction from a position of making contact with the second coupling member, and an urging mechanism causing a prescribed urging force to act in a downward direction on the first coupling member;

a wire capable of suspending the lift cage in an elevator shaft via the coupling mechanism; and a winding apparatus capable of winding the wire up and down, wherein the first coupling member is fixed to one end of the wire, and the second coupling member is fixed to the lift cage, wherein an entirety of the first block is disposed below the one end of the wire, and wherein the urging mechanism has a weight suspended from the first coupling member.

* * * * *